United States Patent [19]

Kohama et al.

[11] 4,222,237

[45] Sep. 16, 1980

[54] EXHAUST GAS PURIFYING APPARATUS FOR INTERNAL COMBUSTION ENGINE

[75] Inventors: Tokio Kohama, Nishio; Hideki Obayashi, Hoi; Tadashi Ozaki, Nishio; Hidetaka Nohira, Mishima, all of Japan

[73] Assignees: Nippon Soken, Inc., Nishio; Toyota Jidosha Kogyo Kabushiki Kaisha, Toyota, both of Japan

[21] Appl. No.: 936,850

[22] Filed: Aug. 25, 1978

[30] Foreign Application Priority Data

Aug. 29, 1977 [JP] Japan ..... 52-103480

[51] Int. Cl.[2] ..... F01N 3/10

[52] U.S. Cl. ..... 60/276; 60/290

[58] Field of Search ..... 60/276, 289, 290

[56] References Cited

U.S. PATENT DOCUMENTS

| | | | |
|---|---|---|---|
| 3,931,710 | 1/1976 | Hartel | 60/290 |
| 3,962,867 | 6/1976 | Ikeura | 60/290 |
| 3,992,878 | 11/1976 | Moorman | 60/290 |
| 4,146,986 | 4/1979 | Kohama | 60/290 |

FOREIGN PATENT DOCUMENTS

| | | | |
|---|---|---|---|
| 2619875 | 7/1977 | Fed. Rep. of Germany | 60/290 |

*Primary Examiner*—Douglas Hart

*Attorney, Agent, or Firm*—Cushman, Darby & Cushman

[57] ABSTRACT

An exhaust gas purifying apparatus for internal combustion engine of the type having an intake conduit for supplying air-fuel mixture to the engine, an exhaust conduit for conducting exhaust gas discharged from the engine to a catalyst for purifying the exhaust gas, secondary air supply pump driven by the engine for supplying secondary air to the exhaust conduit and detector for detecting oxygen content of the exhaust gas. The negative pressure in the intake conduit is compared with the differential pressure produced across a restriction disposed in the secondary air supply conduit thereby to control the quantity of the secondary air supply so as to be proportional to the quantity of the intake in dependence on the result of the comparison. The output signal of the oxygen detector is utilized for modifying the above control.

16 Claims, 8 Drawing Figures

EXHAUST GAS PURIFYING APPARATUS FOR INTERNAL COMBUSTION ENGINE

BACKGROUND OF THE INVENTION

1. FIELD OF THE INVENTION

The present invention relates to an exhaust gas purifying apparatus for internal combustion engines. In more particular, the invention concerns an exhaust gas purifying apparatus of the type including three-way catalyst a secondary air supply system and an air-fuel ratio detector, wherein the air-fuel ratio detected from the exhaust gas is so controlled that optimum purification condition is provided for the purifying action of the three-way catalyst.

2. DESCRIPTION OF THE PRIOR ART

In general, the so-called three-way catalyst which is supported in a single catalyst floor and serves to oxidize carbon monooxide (CO) and hydrocarbon (HC), while reducing nitrogen oxides (NOx) contained in the exhaust gas of the internal combustion engine thereby to eliminate these toxic compounds, has purification performance characteristics variable as functions of the air-fuel ratio such as illustrated in FIG. 1 of the accompanying drawings. As can be seen from FIG. 1, the air-fuel ratio detected from the exhaust gas has to be maintained at a value lying in the range shown as hatched in this figure, in order to have the three-way catalyst to be operated at a high purification efficiency.

In the case of hitherto known exhaust gas purifying apparatus, a secondary air supply is made to the exhaust gas conduit upstream of the three-way catalyst in combination with the use of an air-fuel ratio detector for detecting oxygen concentration of the exhaust gas which undergoes variations in dependence on the operating conditions of the engine, whereby the quantity of the secondary air supply is corrected in consideration of the output conditions of the air-fuel ratio detector thereby to assure the optimum air-fuel ratio for the effective action of the three-way catalyst.

As the means for supplying the secondary air, there has been usually employed an air pump which is driven by the engine. Accordingly, the quantity of air discharged from the air pump depends only on the revolution number of the engine independently from the load thereof. In this connection, FIG. 2 of the accompanying drawings shows relation between the air-fuel ratio of the exhaust gas and the suction pressure in the intake conduit or passage of an internal combustion engine under the conditions that a conventional type of the air pump is used with the revolution number of the engine assumed to be constant. On the above assumption, the quantity of the secondary air supply remains to be constant because of the constant revolution number of the engine. In contrast thereto, the quantity of the exhaust gas will vary in dependence on the load of the engine (i.e. the exhaust gas increases as the load becomes greater). For these reasons, in a conventional secondary air supply system in which the quantity of the secondary air supply is preadjusted to be optimum under its maximum load operation of the engine, the air-fuel ratio of the exhaust gas becomes thinner as the load is lower, as shown in FIG. 2.

In general, in the case where the secondary air supply from the air pump is controlled by means of the air-fuel ratio detector, the control is usually effected in an intermittent manner (i.e. on-off control) in consideration of the response characteristics of the control system. In such control system, a control valve apparatus is provided in the secondary air supply conduit to control the secondary air flow and the air-fuel ratio of the exhaust gas having been mixed with the secondary air is detected by the air-fuel ratio detector. When the output signal voltage from the detector is higher than a preset reference voltage, then the air control valve is opened fully. On the other hand, when the detector output is lower than the reference voltage, the air valve is closed completely. In the fully opened position of the air valve, all the secondary air quantity supplied from the air pump is relieved and in the fully closed position of the air valve, all the secondary air quantity is fed to the exhaust conduit without relief, while in the intermediate valve position between the fully opened and the completely closed positions, appropriate relief of the secondary air depends on the valve position and/or the pressure of the secondary air. In this manner, the air-fuel ratio of the exhaust gas is maintained at values falling within the hatched range shown in FIG. 1 thereby to attempt to attain an effective elimination of the toxic components through the action of the three-way catalyst.

In connection with the control system described above, it will be noted that when the secondary air control valve is completly closed, the air-fuel ratio set by the carburetor is effective, while the air-fuel ratio of the exhaust gas exhibiting such behavior as shown in FIG. 2 becomes effective when the secondary air valve is fully opened.

Referring to FIG. 3 of the accompanying drawings, it is known that more than 80% of purification ratio can be attained in respect to all the compounds CO, HC and NOx by using the three-way catalyst in the air-fuel ratio region indicated by the hatched lines. In this figure, discrete points labelled with associated negative suction pressures in the intake conduit of the engine represent values of the air-fuel ratio of the exhaust rewriten from the graph of FIG. 2. As can be seen from FIG. 3, the air-fuel ratio of the exhaust gas is more remarkably deviated from the range which allows more than 80% of purification of the toxic compounds described above, as the load of the engine becomes reduced. In other words, it is impossible to attain satisfactory purification of the exhaust gas in the low load range with the hitherto known control system where the secondary air supply from the air pump driven by the engine is controlled by the air-fuel ratio detector disposed in the exhaust conduit of the engine.

SUMMARY OF THE INVENTION

Accordingly, an object of the invention is to provide an improved exhaust gas purifying apparatus of the type described hereinbefore which is evaded from the drawbacks of the hitherto known exhaust gas purifying apparatus described above.

Another object of the invention is to provide an exhaust gas purifying apparatus in which the air-fuel ratio of the exhaust gas is controlled independently from the load of internal combustion engine thereby to assure constantly optimum air-fuel ratio for the possible highest catalystic action of the used three-way catalyst.

In view of above and other objects which will become more apparent as description proceeds, it is proposed according to an aspect of the invention that the quantity of the secondary air supplied to the exhaust conduit to be mixed with the exhaust gas from the engine before the detection of the air-fuel ratio is made proportional to the intake air quantity supplied to the engine.

More particularly, there is proposed according to a general aspect of the invention an exhaust gas purifying apparatus for internal combustion engines of a type having an intake conduit, an exhaust conduit and a secondary air supplier for supplying secondary air to the exhaust conduit in a flow rate proportional to the operating speed of the engine, further comprising first means for producing a first signal representative of the flow rate of intake air to be introduced through the intake conduit into the engine, second means for producing a second signal representative of a flow rate of secondary air to be introduced from the secondary air supplier into the exhaust conduit, means for comparing the first signal with the second signal to produce a control signal, means responsive to the control signal for controlling the flow rate of the secondary air to be introduced into the exhaust conduit in proportion to the flow rate of intake air to be introduced into the engine, means for detecting oxygen content of the exhaust gas in the exhaust conduit downstream of a position at which secondary air is introduced into the exhaust conduit, and means for modulating first or second signal when the detected oxygen content exceeds a predetermined level.

The above and other objects, features and advantages of the invention will become more apparent from the description of exemplary embodiments of the invention. The description makes reference to the accompanying drawings.

DETAILED DESCRIPTION OF THE PREFERRED EMBODIMENTS

Figure 1:
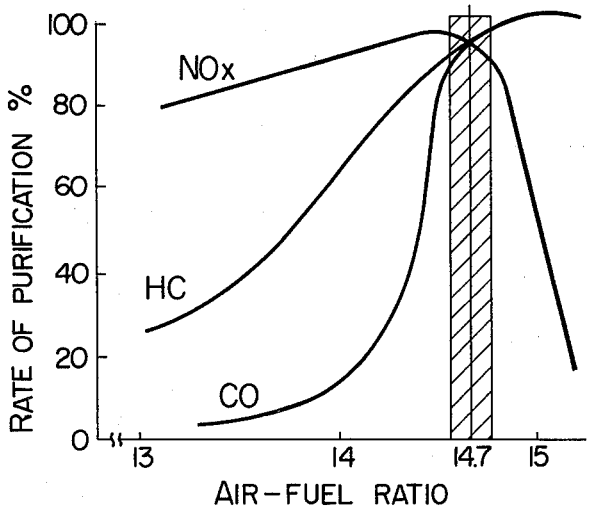
FIG. 1 shows graphically exhaust gas purification characteristics of a typical three-way catalyst.
Figure 2:
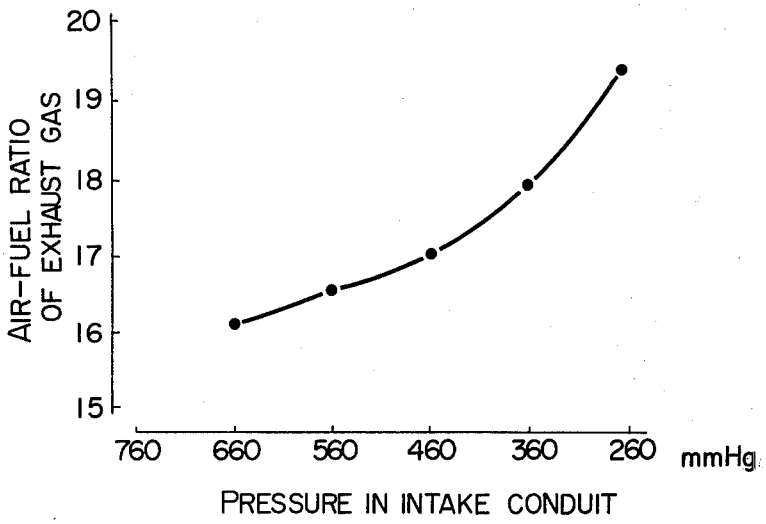
FIG. 2 illustrates graphically a relation between the air-fuel ratio of exhaust gas and negative suction pressure in the intake conduit of an engine in a hitherto known secondary air supply control system using an air pump driven by the engine.
Figure 4:
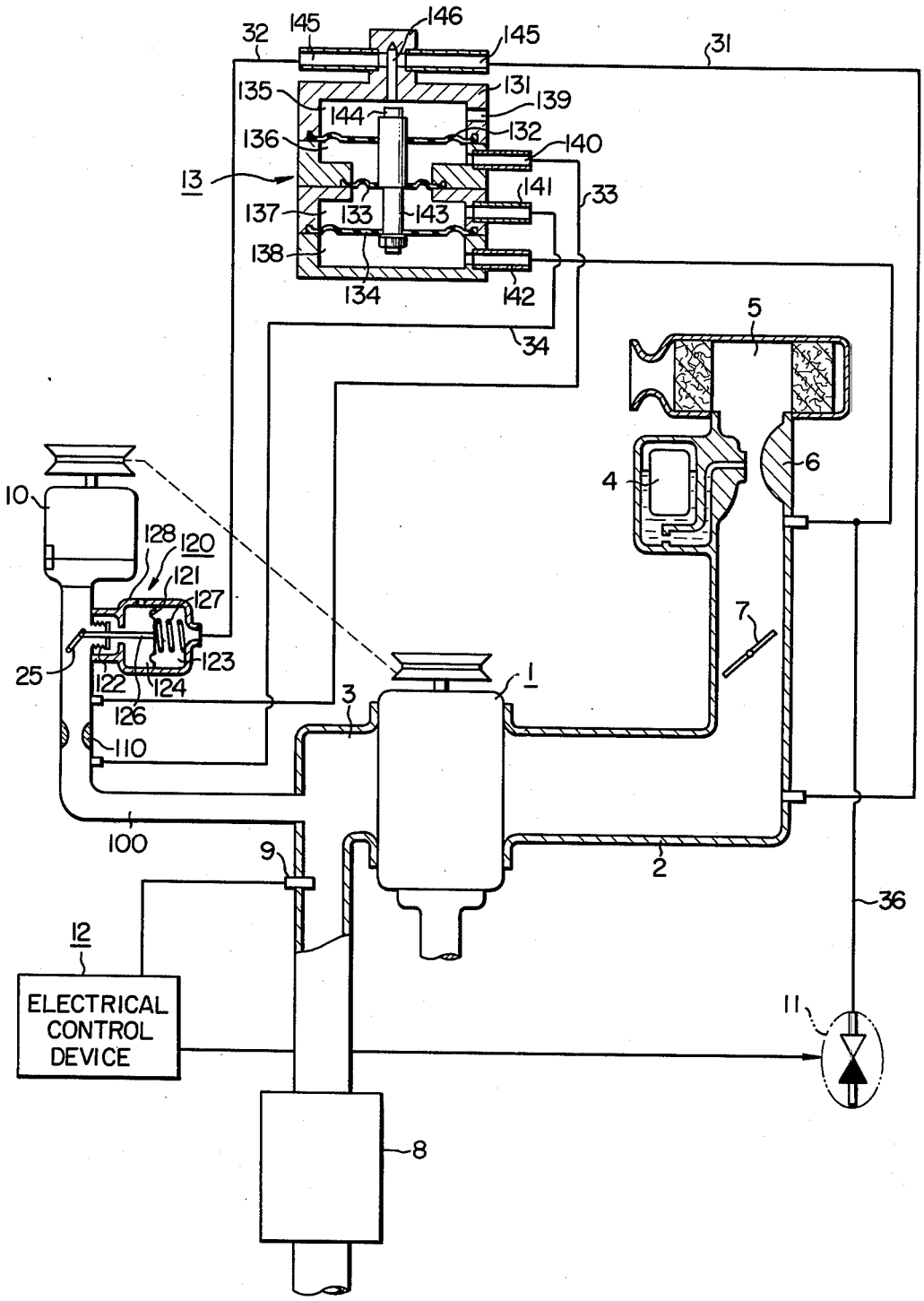

Referring to FIG. 4 showing a first exemplary embodiment of the invention, reference numeral 1 denotes generally an internal combustion engine having an intake manifold or conduit 2 and an exhaust manifold or conduit 3. The intake conduit 2 is provided with a carburetor 4 which serves to supply an air-fuel mixture to the engine 1 and has a venturi 6 positioned upstream of a throttle valve 7 disposed in the intake conduit 2. An air cleaner 5 is provided to purify air supplied to the engine 1. The exhaust conduit 3 extending from the engine 1 is provided with an air-fuel ratio detector 9 of a conventional type for detecting the air-fuel ratio on the basis of the oxygen concentration in the exhaust gas thereby to produce an output signal representative of the detected air-fuel ratio, as graphically illustrated in FIG. 5. Disposed downstream of the air-fuel ratio detector 9 is a three-way catalyst 8 which serves to promote oxidization of CO and HC as well as reduction of NOx contained in the exhaust gas with the purification characteristics shown in FIG. 1, thereby to eliminate these toxic compounds. In particular, the catalyst 8 is adapted to eliminate all of CO, HC and NOx with the possible highest purification capability when the air-fuel ratio is in the vicinity of the stoichiometric value (14.7). An air pump 10 is driven by the engine 1 and constitutes an air supplier. Air discharged from the air pump 10 is introduced into the exhaust conduit 3 at a location upstream of the air fuel ratio detector 9 through a conduit 100 in which there are disposed an air control valve apparatus 120 and a restriction 110. The former 120 functions to control the quantity of secondary air supplied to the exhaust conduit 3 from the air pump 10 by correspondingly varying the flow sectional area of the conduit 100, while the restriction 110 serves to measure the quantity of such secondary air supply.

The air control valve apparatus 120 is composed of a valve element 125 disposed in the secondary air supply conduit 100 and adapted to be rotated to a closing and an open positions by a diaphragm 121 reciprocatably moved in response to a control pressure signal produced in a manner described hereinafter. The air control valve apparatus 120 comprises a housing 128 having two pressure chambers 123 and 124 defined therein by the diaphragm 121 and a bellows 122. The first pressure chamber 123 located at the righthand side as viewed in FIG. 4 is applied with the control pressure signal, while the second pressure chamber 124 is opened to the atmosphere. A compression spring 127 is disposed in the first pressure chamber 123 for urging the diaphragm 121 to the left as viewed in FIG. 4. The valve element 125 is connected to the diaphragm 121 by means of a rod 126.

Reference numeral 13 denotes generally a comparison apparatus which is adapted to compare the intake air quantity supplied to the engine with the secondary air quantity fed from the air pump 10, thereby to make the secondary air quantity to be constantly proportional to the intake air quantity. In more detail, the comparison apparatus 13 has a housing 131 having four pressure chambers 135, 136, 137 and 138 defined therein by three diaphragms 132, 133 and 134. The first pressure chamber 135 defined between the housing 131 and the first diaphragm 132 is conducted to the atmosphere through an inlet port 139. The second pressure chamber 136 defined between the first and second diaphragms 132 and 133 within the housing 131 is applied with a pressure prevailing immediately upstream of the restriction 110 through a first pipe 140 and a third pressure conduit 33. On the other hand, the third pressure chamber 137 defined between the second and the third diaphragms 133 and 134 within the housing 131 is supplied with pressure prevailing immediately downstream of the restriction 110 through a second pipe 141 and a fourth pressure conduit 34. Finally, the fourth pressure chamber 138 defined between the housing 131 and the third diaphragm 134 is applied with a negative pressure prevailing at the venturi 6 of the carburetor 4 by way of a third pipe 142 and a fifth pressure conduit 35. All of three diaphragms 132, 133 and 134 are secured to an interconnecting shaft 143 having a valve seat member 144 mounted fixedly at a free end thereof, which valve seat 144 is adapted to open and close a communication port 146 formed between the first pressure chamber 135 and a fourth pipe 145. The pipe 145 has an end connected to a first pressure conduit 31 through which a negative pressure prevailing downstream of the throttle valve 7 in the intake conduit 2 is supplied. The other end of the fourth pipe 145 is connected to a second pressure conduit 32 for transmitting the negative pressure in the intake conduit 2 to the first pressure chamber 123 of the air control valve apparatus 120. It should be noted that the second diaphragm 133 has an effective area smaller than those of the other diaphragms 132 and 134, while the effective area of the first diaphragm 132 is selected equal to that of the third diaphragm 134. In this connection, the term "effective area" means the area of diaphragm exposed to pressure medium.

With the arrangement described above, the force $W_1$ produced due to the negative pressure $P_3$ of venturi (acting in the downward direction as viewed in FIG. 4) and the force $W_2$ produced due to the differential pressure across the restriction 110 (acting in the upward direction as viewed in FIG. 1) can be expressed as follows:

$$W_1 = P_1 \cdot A_1$$
$$W_2 = P_2 \cdot A_1 - P_2 \cdot A_2 - P_3 \cdot A_1 + P_3 \cdot A_2 = (P_2 - P_3)(A_1 - A_2)$$

where $P_1$: represents the absolute value of the negative pressure of venturi, $P_2$: represents the absolute value of the positive pressure prevailing upstream of the restriction 110, $P_3$: represents the absolute value of positive pressure produced downstream of the restriction 110, $A_1$: represents the effective area of the first and the third diaphragms 132 and 134, respectively, and $A_2$: represents the effective area of the second diaphragm 133.

It will be appreciated that displacement of the shaft 143 depends on the difference in magnitude between the forces $W_1$ and $W_2$.

Assuming that the forces $W_1$ and $W_2$ are balanced with each other in the operating state of the apparatus as illustrated, any increase in the intake air quantity as accompanied by a corresponding increase in the negative pressure of venturi applied to the fourth pressure chamber 138 will involve downward movement of the shaft 143 and the valve seat member 144 as viewed in FIG. 4, as a result of which air quantity flowing into the fourth pipe 145 from the atmosphere through the communication port 146 will be increased thereby to lower the negative suction pressure in the fourth pipe 145 derived from the intake conduit 2. On the contrary, when the negative pressure of venturi is reduced, the valve seat member 144 will be displaced upwardly as viewed in the drawing, whereby air flow from the atmosphere into the fourth pipe 145 is reduced or completely intercepted, thereby to increase the negative suction pressure in the fourth pipe 145 over the one prevailed immediately before. When the secondary air flow is increased, resulting in the corresponding increase in the differential pressure produced across the restriction 110 and sensed by the second and the third pressure chambers 136 and 137, then the shaft 143 and hence the valve seat member 144 will be displaced upwardly as viewed in the drawing, whereby air flow into the fourth pipe 145 from the atmosphere will be reduced or completely intercepted to increase the negative suction pressure over the one prevailed therein immediately before. To the contrary, decreasement in the differential pressure across the restriction 110 applied to the second and the third pressure chambers 136 and 137 as produced upon decreasement in the secondary air flow will then cause the valve seat member 144 to be moved downwardly as viewed in FIG. 4, resulting in that the air flow into the fourth pipe 145 from the atmosphere is increased thereby to reduce the negative suction pressure in the fourth pipe 145.

As can be seen from FIG. 4, a sixth pressure conduit 36 is branched from the fifth pressure conduit 35 and has an electromagnetic two position valve 11 mounted at the free end portion thereof. When the solenoid of two position valve 11 is electrically energized, the valve 11 is opened to the atmosphere, and otherwise the valve 11 remains in the closed state. The control of such operation of the electromagnetic two-position valve 11 is made by an electrical control device 12 in dependence on the output state of the air-fuel ratio detector 9. In other words, the control device 12 and the valve 11 constitute a second control apparatus for controlling the secondary air supply in dependence on the output signal from the air-fuel ratio detector 9 in an intermittent manner.

Figure 6:
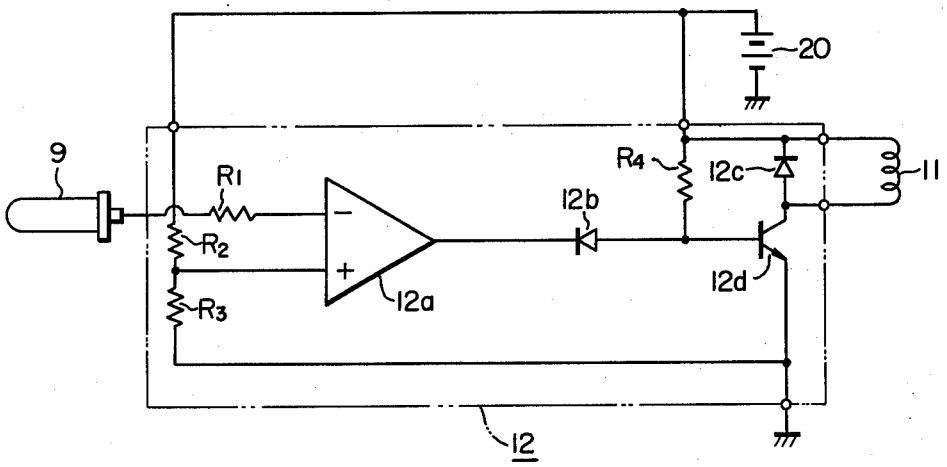
FIG. 6 is a circuit diagram showing a circuit configuration of the electrical control device employed in the apparatus shown in FIG. 4.

An exemplary embodiment of the control device 12 is shown in FIG. 6. In this figure, reference character **12*a* indicates comparator constituted by an operational amplifier having a first input terminal connected to the output terminal of the air-fuel ratio detector 9 through an adjusting resistor R1 and a second input terminal to be applied with a preset reference voltage adjustable through resistors R2 and R3. The preset reference voltage is selected to be substantially equal to the voltage applied to the first input terminal of the comparator 12*a*, when the detected air-fuel ratio is substantially same as the stoichiometric ratio. The output terminal of the comparator 12*a* is connected to a base electrode of a transistor 12*d* through a diode 12*b*. The emitter of the transistor 12*d* is grounded, while the collector thereof is connected to a power source 20 through a parallel connection of a diode 12*c* and the solenoid coil of the electromagnetic two-position valve 11. Reference character R4** denotes a bias resistor.

Figure 5:
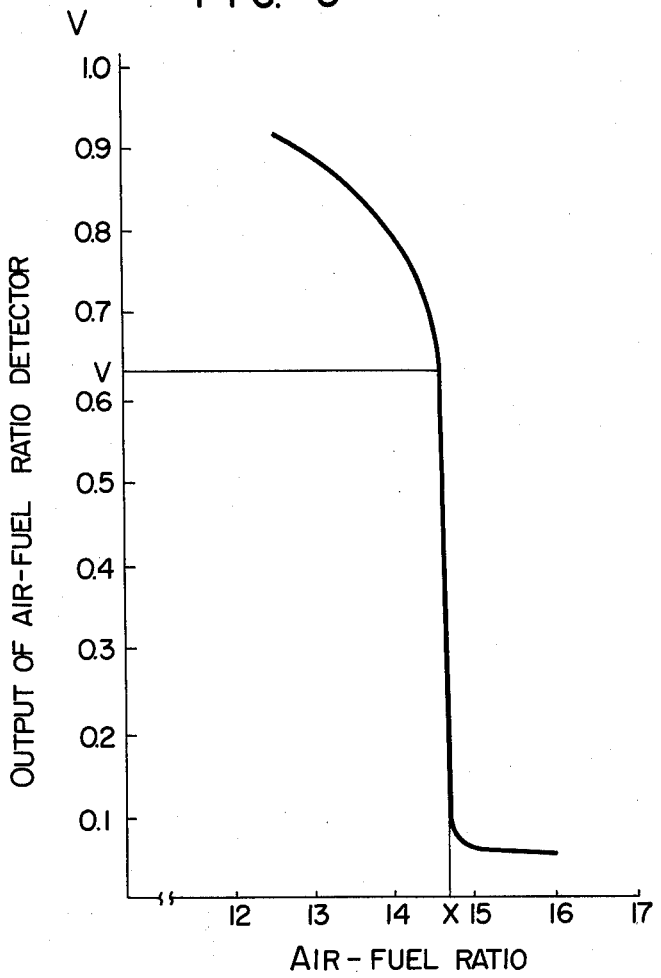
FIG. 5 shows graphically output characteristic of the air-fuel ratio detector employed in the apparatus shown in FIG. 4.

Assuming that the air-fuel ratio of the exhaust gas sensed by the detector 9 is smaller than a desired air-fuel ratio X illustrated in FIG. 5, the output voltage from the air-fuel ratio detector 9 will become higher than a desired or target voltage V (refer to FIG. 5), as the result of which the output signal of the comparator **12*a* is logic "0". The electromagnetic two-position valve 11 will thus remain in the deenergized state. On the other hand, when the actual air-fuel ratio as detected is higher than the desired air-fuel ratio X, the output from the air-fuel ratio detector 9 will become lower than the desired voltage V, whereby the output signal of the comparator 12*a* becomes logic "1" to electrically energize the solenoid two-position valve 11**.

Now, description will be made on operation of the apparatus having the arrangement described above. Air-fuel mixture as produced from the carburetor 4, the quantity of which is determined by the opening degree of the throttle valve 7, is supplied to the engine 1 and the combustion products are discharged into the atmosphere as the exhaust gas through the exhaust conduit 3. In this case, there is produced at the venturi 6 of the carburetor 4 a negative pressure having a magnitude related to the intake air quantity. The relation between the negative pressure and the intake air quantity can be given by the following expression:

$$Q = C_1 \cdot A_3 \sqrt{P_1}$$

where

Q: intake air quantity, $A_3$: flow sectional area of the venturi 6, $P_1$: absolute value of the negative pressure at the venturi 6, and $C_1$: flow coefficient.

On the other hand, the air pump 10 driven by the engine 1 supplies the secondary air to the exhaust conduit through the secondary air supply conduit 100. The value of the differential pressure produced across the restriction 110 provided in the conduit 100 is related to the secondary air supply quantity according to the following expression:

$$q = C_2 \cdot A_4 \sqrt{P_2 - P_3}$$

where q: secondary air supply quantity, $A_4$: flow sectional area of the restriction 110, $P_2$: pressure prevailing upstream of the restriction 110, $P_3$: pressure prevailing downstream of the restriction 110, and $C_2$: flow coefficient.

The quantity of supplied secondary air is controlled to be proportional to the quantity of intake air. More specifically, the comparison apparatus 13 controls the air flow control valve apparatus 120 on the basis of the result of comparison between the negative pressure at the venturi 6 and the differential pressure across the restriction 110 thereby to regulate the flow sectional area of the conduit 100 in such a way that the differential pressure across the restriction 110 becomes proportional to the absolute value of the negative pressure of venturi, i.e. $P_1 = K(P_2 - P_3)$ where K is a proportional constant. Under such condition, there can be attained a proportional relation between the intake air quantity Q and the secondary air quantity q, i.e. $Q = K_2 \cdot q$, where $K_2$ is a proportional constant.

In more detailed description of operation, it is assumed that the pressure signal representative of the intake air quantity or the absolute value of the negative pressure at venturi 6 is proportionally balanced with the pressure signal representative of the secondary air supply quantity or the value of the differential pressure across the restriction 110 in the state of the system illustrated in FIG. 4. Starting from such state, when the intake air quantity is increased thereby to increase the negative pressure of venturi, the negative suction pressure applied to the first pressure chamber 123 of the pressure control valve apparatus 120 will become reduced through the control operation of the comparison apparatus 13 described above, involving rotation of the valve element 125 in the open direction to increase the flow sectional area of the passage 100. This will result in an increased quantity of the secondary air supplied to the exhaust conduit 3.

On the other hand, when the intake air quantity is decreased, involving a correspondingly lowered negative pressure at the venturi 6, the negative suction pressure applied to the first pressure chamber 123 of the air control valve apparatus 120 is increased through the operation of the comparison apparatus 13 described above, causing the valve element 125 to be rotated in the closing direction thereby to decrease the secondary air quantity supplied to the exhaust conduit 3.

Further, when the differential pressure across the restriction 110 is increased excessively due to the correspondingly increased secondary air flow, the negative suction pressure applied to the first pressure chamber 123 of the air control valve apparatus 120 is increased through the operation of the comparison apparatus 13 described above, whereby the valve element 125 is rotated in the closing direction. To the contrary, an excessively decreased differential pressure across the restriction 110 as caused by the decreasement in the secondary air flow will lower the negative suction pressure applied to the first pressure chamber 123 of the air control valve apparatus 120 so that the valve element 125 is caused to rotate in the opening direction. In this manner, it is possible to proportionate the secondary air supply to the intake air quantity by controlling the valve element 125 so that the signal representative of the secondary air flow (i.e. the differential pressure value appearing across the restriction 110) is proportionally balanced with the signal representative of the intake air quantity (i.e. the absolute value of the negative pressure at the venturi 6).

In the exhaust conduit 3, the combustion products or the exhaust gas is mixed with the secondary air which is supplied from the air pump 10 in the proportional dependence on the intake air quantity as described above, before reaching the air-fuel ratio detector 9. In this connection it is to be noted that the secondary air supply is previously set such that the air-fuel ratio of the exhaust gas as detected is constantly at a value (e.g. 17.0) higher than the desired air-fuel ratio X (refer to FIG. 5). On the other hand, the air-fuel ratio of the air-fuel mixture prepared by the carburetor 4 is set at a value (e.g. 13.5) smaller than the desired ratio.

In connection with the control of the secondary air supply to the exhaust conduit 3 from the air pump 10 in proportion to the intake air quantity, as the air-fuel ratio of the exhaust gas is preset at a value higher than the desired ratio X as described above, the output level of the air-fuel ratio detector 9 is lower than the desired voltage V, whereby the solenoid two-position valve 11 is electrically energized by the control circuit 12 described hereinbefore and opened. Thus, the fifth pressure conduit 35 is opened to the atmosphere through the sixth pressure conduit 36, resulting in that the negative venturi pressure applied to the fourth chamber 138 is lowered to a value approximating to the atmospheric pressure. Under such circumstance, the shaft 143 and the valve seat member 144 of the comparison apparatus 13 is moved upwardly under the force due to the differential pressure across the restriction 110, as the result of which the flow of the ambient air into the fourth pipe 145 is decreased or completely intercepted to increase the negative suction pressure in the fourth pipe 145 over the one prevailed therein immediately before. As a consequence, the valve element 125 of the air control valve apparatus 120 is rotated in the direction to reduce the flow sectional area of the passage 100 thereby to correspondingly decrease the quantity of the secondary air supply. The air-fuel ratio of the exhaust gas can thus approach to the desired value X.

On the other hand, when the air-fuel ratio of the exhaust gas becomes smaller than the desired ratio, the output voltage from the detector 9 becomes higher than the desired voltage V, whereby the electromagnetic valve 11 is deenergized through the control device 12. Under the condition, since the negative pressure at the venturi of the carburetor 4 is introduced into the fourth pressure chamber 138 without being decreased to the atmospheric pressure, the air-fuel ratio detected from the exhaust gas becomes higher than the desired ratio X.

In this manner, the air-fuel ratio of the exhaust gas on an average is constantly controlled so as to be at or around the desired ratio, allowing thus the toxic compounds such as CO, HC and NOx to be removed in a satisfactory manner by the three-way catalyst 8.

Figure 7:
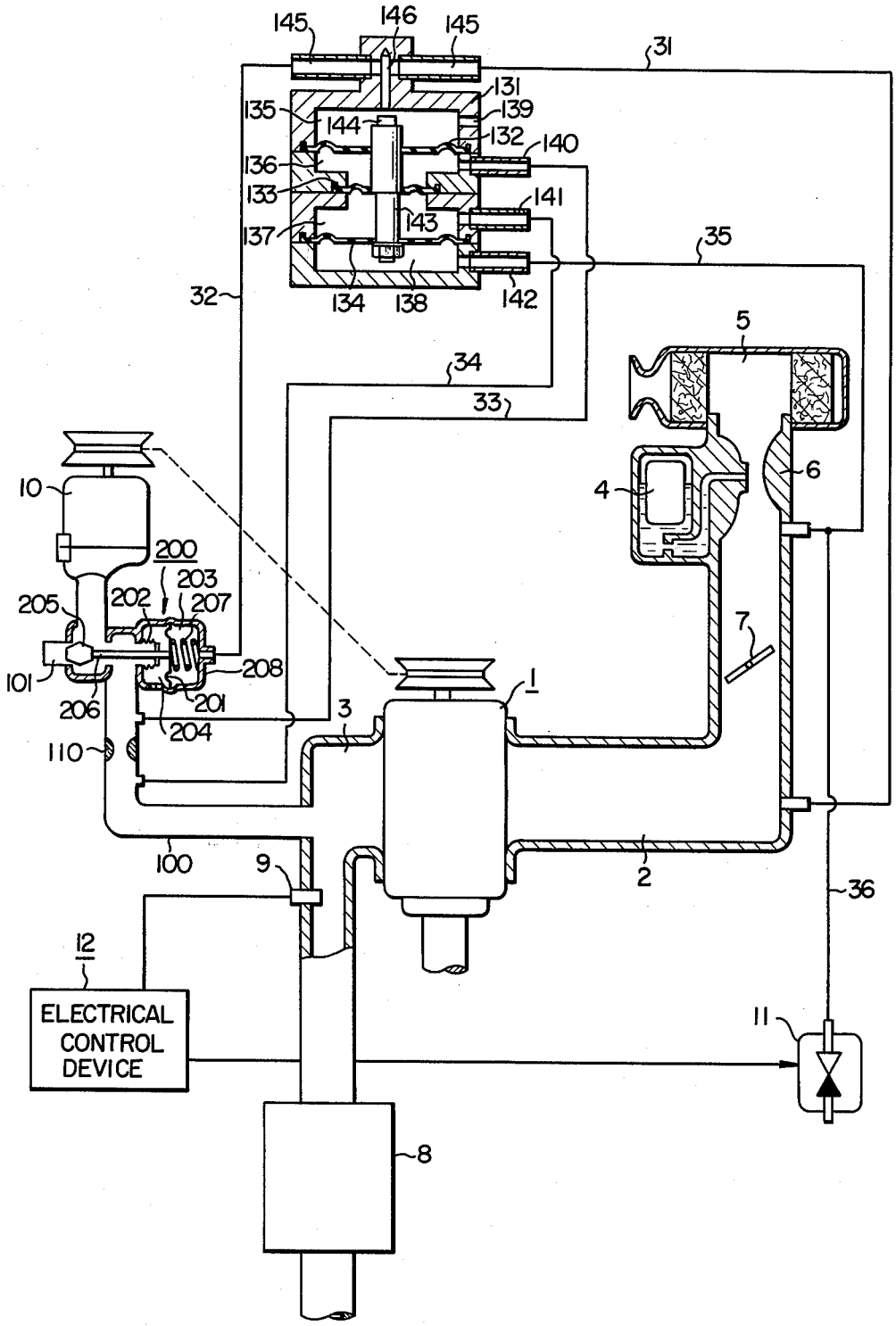
FIG. 7 shows schematically a general arrangement of the purification apparatus according to a second embodiment of the invention.

FIG. 7 shows a second exemplary embodiment of the invention in which the air control valve apparatus 120 described above in conjunction with FIG. 4, is replaced by another type of the air control valve apparatus constituted by a three-way valve to the substantially same effect. More specifically, the air control valve apparatus denoted generally by the reference numeral 200 comprises a diaphragm 201 and a valve element 205 operated by the diaphragm 201. There are defined two pressure chambers 203 and 204 in the housing 208 of the apparatus 200 by the diaphragm 201 and a bellows 202. The first pressure chamber 203 is applied with the pressure signal derived from the comparison apparatus 13, while the second pressure chamber 204 is opened to the atmosphere in the similar manner as described hereinbefore. A compression spring 207 is accommodated within the first pressure chamber 203 for urging the diaphragm 201 to the left as viewed in FIG. 7. The valve element 205 is connected to the diaphragm 201 through a shaft 206 and serves to control the flow sectional area of the secondary air supply conduit 100 as well as a relief passage 101 for adjusting the quantity of the secondary air supply. The remaining structure of the apparatus shown in FIG. 7 as well as the operation thereof are same as those of the apparatus shown in FIG. 4. Accordingly, further description will be unnecessary.

In connection with the embodiments shown in FIGS. 4 and 7, it should be noted that the sixth pressure conduit 36 may be connected to the fourth pressure conduit 34 at one end thereof with the other end portion being provided with the electromagnetic two-position valve 11 instead of being connected to the fifth pressure conduit 36 as shown in FIGS. 4 and 7.

Figure 8:
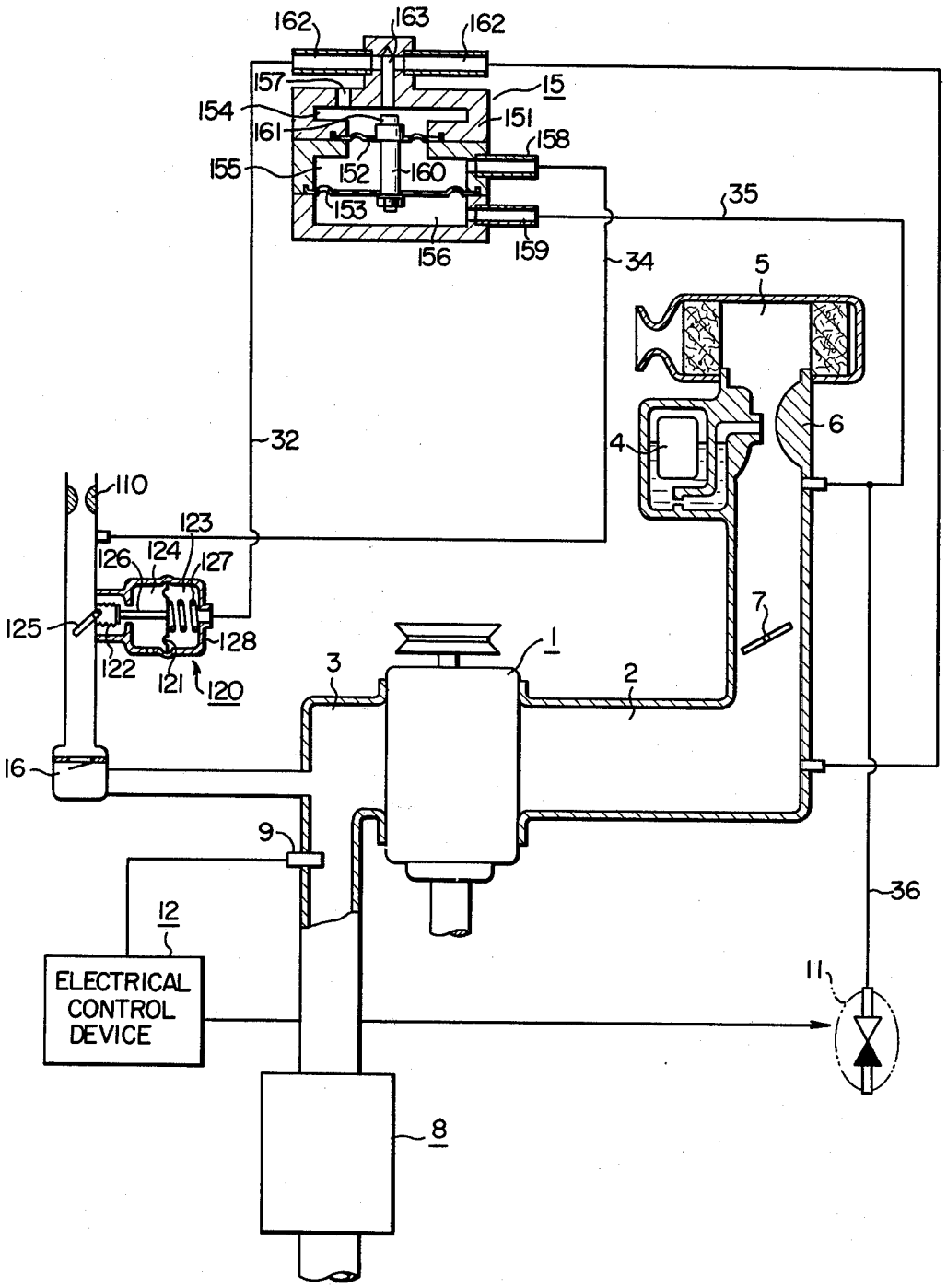
FIG. 8 shows a third embodiment of the invention.

FIG. 8 shows a third exemplary embodiment of the invention in which an air suction valve 16 adapted to operate by making use of the pulsation behavior of the exhaust gas is used in place of the air pump 10 employed as the secondary air supply means. In this embodiment, it will be noted that the restriction 110 is located upstream of the air control valve apparatus 120. The differential pressure appearing across the restriction 110 is also utilized as the signal representative of the secondary air supply quantity as fed from the suction valve 16 to the exhaust conduit 3. However, since the upstream side of the restriction 110 is opened to the atmosphere, it is only necessary to detect the pressure prevailing downstream of the restriction 110. For this reason, the comparison apparatus 15 corresponding to those 13 shown in FIGS. 4 and 7 is simplified in respect of the structure, as described below.

The comparison apparatus 15 comprises a housing 151 having three pressure chambers 154, 155 and 156 defined therein by disphragms 152 and 153. The first pressure chamber 154 defined in the housing by the first diaphragm 152 is communicated to the atmosphere through an inlet port 157, while the second pressure chamber 155 defined between the first and the second diaphragms 152 and 153 is applied with the pressure prevailing immediately downstream of the restriction 110 through a first pipe 158 and the fourth pressure conduit 34. Finally, the third pressure chamber 156 defined in the housing 151 by the second diaphragm 153 is applied with the negative pressure at the venturi 6 of the carburetor 4 through a second pipe 159 and the fifth pressure conduit 35. The two diaphragms 152 and 153 are fixedly secured to an interconnecting shaft 160 which in turn has a valve seat member 161 mounted at the free end thereof and adapted to open and close selectively the communication port 163 between the first pressure chamber 154 and a third pipe 162. The third pipe 162 has an end connected to the first pressure conduit 31 and is applied with the negative suction pressure in the intake conduit 2 downstream of the throttle valve 7. The other end of the pipe 162 is connected to the second pressure conduit 32 to transmit the negative suction pressure to the first pressure chamber 123 of the air control valve apparatus 120.

The operation of the comparison apparatus 15 is effected in a substantially similar manner as that of the comparison apparatus 13 described hereinbefore in conjunction with FIGS. 4 and 7. Namely, the function of the comparison apparatus 13 is to make the secondary air supply from the suction valve 16 to be constantly proportional to the intake air quantity by comparing the pressure downstream of the restriction 110 and the negative pressure at venturi 6 of the carburetor 4. The comparison apparatus 15 shown in FIG. 8 can be advantageously implemented in a much simplified structure.

Figure 3:
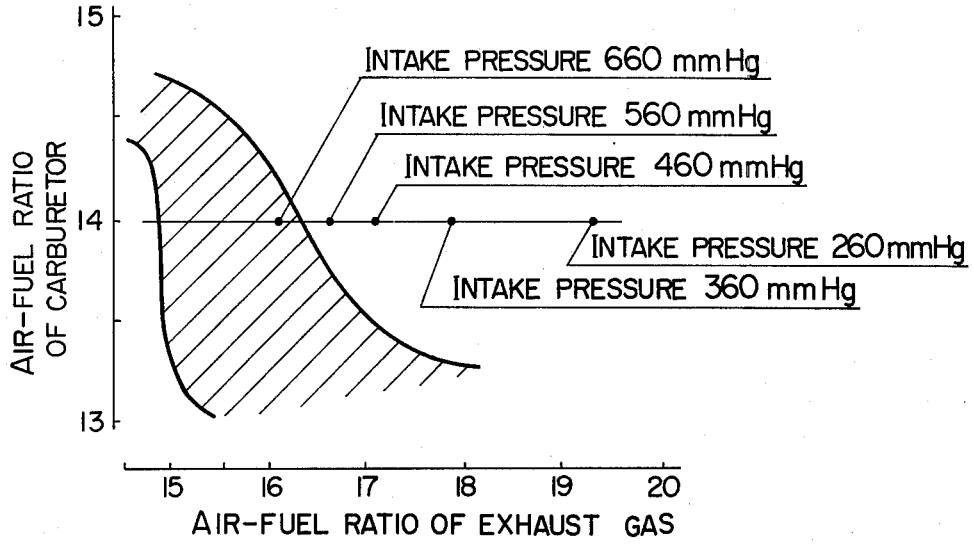
FIG. 3 illustrates graphically the range of the air-fuel ratio of the exhaust gas and that of the carburetor in which more than 80% of purification of all toxic compounds CO, HC and NOx can be attained by using the three-way catalyst in combination with the secondary air control in the exhaust gas system, FIG. 4 schematically shows a general arrangement of the exhaust gas purification apparatus according to a first embodiment of the invention.

As will be appreciated from the foregoing description, the invention has proposed an improved system for purifying exhaust gas of internal combustion engines in which three toxic components of the exhaust gas are purified by the three-way catalyst with the secondary air supply to the exhaust gas being controlled in an intermittent manner in dependence on the output signal from an air-fuel ratio detector and which allows the air-fuel ratio of the exhaust gas to be maintained at a substantially constant value by controlling the secondary air supply so as to be proportional to the intake air quantity. More specifically, the air-fuel ratio can be maintained at values in the hatched range shown in FIG. 3, and thus the toxic components CO, HC and NOx of the exhaust gas can be simultaneously eliminated by a three-way catalyst in a satisfactory manner.

Another advantage of the invention can be seen in the fact that the electrical control device or circuit such as shown in FIG. 6 can be implemented inexpensively in an extremely simplified configuration, since the function of the circuit is merely to discriminate whether the output voltage of the air-fuel ratio detector is higher or lower than a preset voltage level. Further, performances of the engine operation will undergo substantially no influences of the air-fuel ratio control, because the latter is effected through the control of the secondary air supply to the exhaust gas.

Although the preferred embodiments of the invention have been illustrated and described, it will be appreciated that many modifications and variations may readily occur to those skilled in the art without departing from the spirit and scope of the invention.

What is claimed is:

1. In an exhaust gas purifying apparatus for internal combustion engines of the type having an intake conduit for supplying air-fuel mixture to the engine, an exhaust conduit for conducting exhaust gas discharged from the engine, said apparatus comprising secondary air supply means for supplying secondary air through a secondary air supply conduit to said exhaust conduit in a quantity in proportion to the operating speed of the engine, a catalyst disposed in said exhaust conduit downstream of the junction of said secondary air supply conduit to said exhaust conduit for purifying the exhaust gas, means for detecting oxygen content of the exhaust gas after having been mixed with the secondary air, and a secondary air control valve disposed in said secondary air conduit for controlling the quantity of secondary air to be supplied to said exhaust conduit in response to the detected oxygen content of said exhaust gas, the improvement comprising first means for producing a first pressure signal representative of a quantity of intake air being supplied to the engine through said intake conduit.

second means for producing a second pressure signal representative of a quantity of said secondary air being supplied to said exhaust conduit through said secondary air supply conduit, comparison means for comparing said first and second pressure signals to produce a control pressure signal for controlling said secondary air control valve, and means for modulating one of said first and second pressure signals when said detected oxygen content exceeds a predetermined level.

2. An apparatus as set forth in claim 1, wherein said engine further has a carburetor provided with a venturi disposed in said intake conduit and a throttle valve disposed in said intake conduit downstream of said venturi and said first pressure signal is derived from said intake conduit at said venturi and said second pressure signal is derived as a differential pressure across a restriction in said secondary air supply conduit.

3. An apparatus as set forth in claim 2, wherein said secondary air control valve comprises a valve element disposed in said secondary air supply conduit upstream of said restriction for controlling the flow rate of secondary air and a pressure chamber applied with said control pressure signal, said pressure chamber having a movable wall mechanically linked to said valve element thereby to operate said valve element in response to said control pressure signal applied to said pressure chamber.

4. An apparatus as set forth in claim 3, wherein said secondary air supply means comprises an air pump disposed upstream of said valve element and adapted to be driven by said engine.

5. An apparatus as set forth in claim 3 or 4, wherein said secondary air supply conduit is provided with a relief port adapted to be opened by said valve element when said valve element is operated in the direction to close said secondary air supply conduit.

6. An apparatus as set forth in claim 2, wherein said comparison means comprises a pressure conduit having one end for receiving negative pressure prevailing in said intake conduit downstream of said throttle valve and the other end for delivering said control pressure signal to said secondary air control valve, a housing having therein first, second, third and fourth pressure chambers separated from each other by means of diaphragms, said first pressure chamber being opened to the atmosphere and communicated with said pressure conduit through a communication port, said second pressure chamber being applied with pressure in said secondary air supply conduit upstream of said restriction, said third pressure chamber being applied with pressure in said secondary air supply conduit downstream of said restriction, said fourth pressure chamber being applied with said first pressure signal, and a valve seat member disposed in opposition to said communication port and operatively connected to said diaphragms to move toward and away from said port in response to deflection of said diaphragms.

7. An apparatus as set forth in claim 6, wherein said diaphragms disposed between said first and second pressure chambers and between said third and fourth pressure chambers have a same effective area larger than that of said diaphragm disposed between said second and third pressure chambers.

8. An apparatus as set forth in claim 7, wherein said secondary air control valve comprises a valve element disposed in said secondary air supply conduit upstream of said restriction for controlling the flow rate of secondary air and a pressure chamber having a movable wall mechanically linked to said valve element thereby to operate said valve element in response to said control pressure signal applied to said pressure chamber.

9. An apparatus as set forth in claim 6, 7 or 8, wherein said secondary air supply means comprises an air pump disposed upstream of said valve element and adapted to be driven by said engine.

10. An apparatus as set forth in any one of claims 6, 7 or 8 wherein said secondary air supply conduit is provided with a relief port adapted to be opened by said valve element when said valve element is operated in the direction to close said secondary air supply conduit.

11. An apparatus as set forth in claim 2, wherein said comparison means comprises a pressure conduit having one end for receiving negative pressure prevailing in said intake conduit downstream of said throttle valve and the other end for delivering said control pressure signal to said secondary air control valve, a housing having therein first, second and third pressure chambers separated from each other by means of diaphragms, said first pressure chamber opened to the atmosphere and communicated with said pressure conduit through a communication port, said second pressure chamber applied with said second pressure signal, said third pressure chamber applied with said first pressure signal, and a valve seat member disposed in opposition to said communication port and operatively connected to said diaphragms to move toward and away from said port in response to deflection of said diaphragms.

12. An apparatus as set forth in claim 11, wherein said secondary air supply means is constituted by an air suction valve disposed in said secondary air supply conduit downstream of said secondary air control valve and operative in response to pulsation of pressure in said exhaust conduit and said restriction is disposed upstream of said secondary air control valve, said secondary air supply conduit being opened to the atmosphere upstream of said restriction.

13. An apparatus as set forth in claim 12, wherein said diaphragm disposed between said first and second pressure chambers has an effective area smaller than that of said diaphragm disposed between said second and third pressure chambers and said second pressure chamber is applied with pressure in said secondary air supply conduit downstream of said restriction.

14. An apparatus as set forth in claim 11, 12 or 13, wherein said secondary air control valve comprises a valve element disposed in said secondary air supply conduit for controlling the flow rate of secondary air and a pressure chamber having a movable wall mechanically linked to said valve element thereby to operate said valve element in response to said control pressure signal applied to said pressure chamber.

15. An apparatus as set forth in claim 1, wherein said modulating means comprises an electromagnetic two-position valve capable of selectively taking open and closed positions for relieving one of said first and second pressure signals to the atmosphere at said open position and an electrical control circuit having an input connected to said oxygen content detecting means and an output connected to said electromagnetic two-position valve and adapted to open said two-position valve when said oxygen content exceeds said predetermined level.

16. An apparatus as set forth in claim 9, wherein said secondary air supply conduit is provided with a relief port adapted to be opened by said valve element when said valve element is operated in the direction to close said secondary air supply conduit.

* * * * *